US006022297A

United States Patent [19]

DeJesus

[11] Patent Number: 6,022,297

[45] Date of Patent: Feb. 8, 2000

[54] PORTABLE DEVICE OR EXERCISING FRONT THIGHS

[76] Inventor: Carlos DeJesus, 5000 E. Seminary Ave., Richmond, Va. 23227

[21] Appl. No.: 09/085,580

[22] Filed: May 28, 1998

[51] Int. Cl.[7] ..... A63B 69/18

[52] U.S. Cl. ..... 482/70; 482/71

[58] Field of Search ..... 482/70, 71, 142, 482/145, 134, 907, 140; 434/253; 432/121, 123

[56] References Cited

U.S. PATENT DOCUMENTS

| | | | |
|---|---|---|---|
| 1,019,861 | 3/1912 | Titus | 482/123 |
| 4,544,153 | 10/1985 | Babcock . | |
| 4,763,897 | 8/1988 | Yakata . | |
| 4,846,690 | 7/1989 | Williams | 434/253 |
| 4,875,672 | 10/1989 | Armstrong . | |
| 5,112,287 | 5/1992 | Brewer | 482/130 |
| 5,125,649 | 6/1992 | Fuller | 482/123 |
| 5,342,266 | 8/1994 | Dailey | 482/71 |
| 5,480,367 | 1/1996 | Bergman . | |
| 5,480,369 | 1/1996 | Dudley | 482/125 |
| 5,527,242 | 6/1996 | Gangloff . | |
| 5,593,374 | 1/1997 | Gvoich . | |
| 5,653,665 | 8/1997 | Neeley | 482/106 |

*Primary Examiner*—Richard J. Apley
*Assistant Examiner*—Lori Baker
*Attorney, Agent, or Firm*—Richard L. Miller, P.E

[57] ABSTRACT

A portable device for exercising front thighs having a non-use position for carrying by a hand of a user and a use position for placement on a horizontal surface and for exercising the front thighs of the user. The device includes a base, foot restraints, a pair of support straps, and a rod. The base is placed on the horizontal surface when the portable device for exercising front thighs is in the use position. The feet restraints are disposed on the base for restraining the feet of the exerciser when the portable device for exercising front thighs is in the use position. The pair of support straps extend from the base for supporting the exerciser when the portable device for exercising front thighs is in the use position. The rod is placed behind the knees of the exerciser when the portable device for exercising front thighs is in the use position and engages the pair of support straps for further supporting the exerciser when the portable device for exercising front thighs is in the use position.

21 Claims, 1 Drawing Sheet

PORTABLE DEVICE OR EXERCISING FRONT THIGHS

BACKGROUND OF THE INVENTION

1. Field of the Invention

The present invention relates to an exercise device. More particularly, the present invention relates to a portable device for exercising front thighs.

2. Description of the Prior Art

Numerous innovations for exercise devices have been provided in the prior art that will be described. Even though these innovations may be suitable for the specific individual purposes to which they address, however, they differ from the present invention.

FOR EXAMPLE, U.S. Pat. No. 4,763,897 to Yakata teaches a multi-function exercise machine that has a platform, a pivot support fixed to one side of the platform, a pivot lever rotatably mounted to the pivot support and having an exercise bar mounted to its upper end so as to extend over the platform, a stack of weights for applying a selected resistance to the exercise bar, a cable connected between the weight stack and the pivot lever, a plate having an array of holes at angular positions and a retaining pin for adjusting the angular position of the pivot lever on the pivot support so as to define a start position of the exercise bar above the platform, and a clamp for adjusting the length of the cable between the pivot bar and the weight stack taking into account the angular position of the pivot lever. The start position of the exercise bar is adjusted for different sizes of users and types of exercises to be performed on the exercise machine.

ANOTHER EXAMPLE, U.S. Pat. No. 5,480,367 to Bergman teaches an exercise device for exercising the adductor and abductor muscles of the thigh portion of the legs without connecting the device to the legs in which a bar member is provided which can be placed below the thigh or above the knees to extend across the thighs or knees. Side members are provided top extend in the same direction down the inside or outside of the calf portion of the legs so that the device can then be used either for exercising in which the legs move outwardly or to be placed between the knees to provide resistance to inward movement of the thighs. In a preferred form of the invention the bar member is an elongate hollow member with a lid, with one side member permanently attached thereto and the other side member is movable back and forth from a rest position against a resistance force to exercise the adductor and abductor muscles without attachment of the device to the legs. There may be provided means for adjusting the spacing or tension between the end members which can be loaded so as to provide greater resistance as the device is moved inwardly or outwardly. The loading can be effected by a resilient band or spring.

STILL ANOTHER EXAMPLE, U.S. Pat. No. 5,527,242 to Gangloff teaches a specially designed foldable exercise apparatus for doing pull-ups or chin-ups while the heels of the feet remain on the floor. It includes a chrome-plated steel base with welded vertical bar supports extendable upward on each side of the base, with an uninterrupted space provided between the vertical bar supports for the torso of user's body to be placed therebetween. The vertical supports extend upward with one on each side, approximately midway between a front edge and a rear edge of the base, so that the base extends outward in both directions from the vertical support bars. The pull-up supports are fabricated with apertures or notched vertical supports or hooks on the exterior for placement therein of a horizontal support bar which is movable. The support bar is preferably fabricated of tubular steel with rubber caps on each end to prevent slipping off the support bars. The user lies between the support posts and pulls himself or herself up to the desired level while the heels of the user remain on the floor.

FINALLY, YET ANOTHER EXAMPLE, U.S. Pat. No. 5,593,374 to Gvoich teaches a device for exercising the muscles of the gluteal region comprising a rigid frame formed as an elongated bar. A hip support is rotatably attached to the middle of the frame and a back support is attached to the hip support. The device further comprises a bootie having elastic resistance members connected to the toe and heel portions of the bootie.

It is apparent that numerous innovations for exercise devises have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a portable device for exercising front thighs that avoids the disadvantages of the prior art.

ANOTHER OBJECT of the present invention is to provide a portable device for exercising front thighs that is simple and inexpensive to manufacture.

STILL ANOTHER OBJECT of the present invention is to provide a portable device for exercising front thighs that is simple to use.

BRIEFLY STATED, YET ANOTHER OBJECT of the present invention is to provide a portable device for exercising front thighs having a non-use position for carrying by a hand of a user and a use position for placement on a horizontal surface and for exercising the front thighs of the user. The device includes a base, foot restraints, a pair of support straps, and a rod. The base is placed on the horizontal surface when the portable device for exercising front thighs is in the use position. The feet restraints are disposed on the base for restraining the feet of the exerciser when the portable device for exercising front thighs is in the use position. The pair of support straps extend from the base for supporting the exerciser when the portable device for exercising front thighs is in the use position. The rod is placed behind the knees of the exerciser when the portable device for exercising front thighs is in the use position and engages the pair of support straps for further supporting the exerciser when the portable device for exercising front thighs is in the use position.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
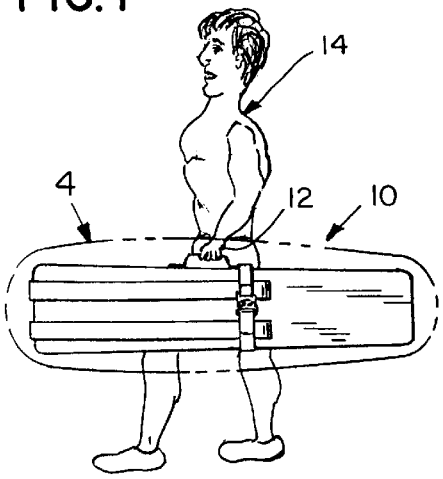
FIG. 1 is a diagrammatic perspective view of the present invention in its non-use position and being transported by an exerciser.

10 portable device for exercising front thighs of the present invention
12 hand 12 of user 14
14 user
15 horizontal surface
16 legs of user 14
18 base
20 feet restraints
22 pair of support straps
24 rod
25 platform of base 18
26 forwardmost end of platform 25 of base 18
28 rearmost end of platform 25 of base 18
30 uppermost surface of platform 25 of base 18
32 lowermost surface of platform 25 of base 18
33 handle of base 18
34 inclined spacer of base 18
36 uppermost surface of inclined spacer 34 of base 18
38 lowermost surface of inclined spacer 34 of base 18
40 forwardmost end of inclined spacer 34 of base 13
42 rearmost end of inclined spacer 34 of base 18
44 one end of each strap of pair of support straps 22
46 loop of each strap of pair of support straps 22
48 other end of each strap of pair of support straps 22
50 wood screw
52 washer
53 foam tube
54 pair of free ends 54 of rod 24
56 anchor of feet restraints 20
58 center strap of anchor 56 of feet restraints 20
59 screws
60 longitudinal loops of center strap 58 of anchor 56 of feet restraints 20
62 pair of chain links of anchor 56 of feet restraints 20
64 pair of non-skid foot pads 64 of feet restraints 20
66 pair of foot straps of feet restraints 20
68 strap portion of each strap of pair of foot straps 66 of feet restraints 20
70 upper surface of strap portion 68 of each strap of pair of foot straps 66 of feet restraints 20
72 fixed end of strap portion 68 of each strap of pair of foot straps 66 of feet restraints 20
73 screws
74 free end of strap portion 68 of each strap of pair of foot straps 66 of feet restraints 20
76 one portion of hook and loop fasteners of strap portion 68 of each strap of pair of foot straps 66 of feet restraints 20
78 mating portion of hook and loop fasteners of strap portion 68 of each strap of pair of foot straps 66 of feet restraints 20

DETAILED DESCRIPTION OF THE PREFERRED EMBODIMENT

Figure 2:
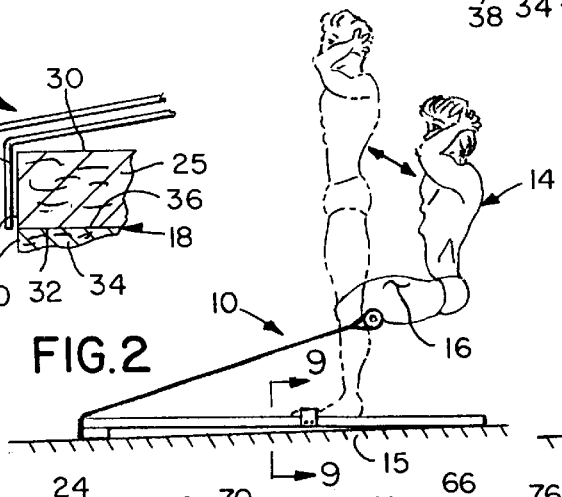
FIG. 2 is a diagrammatic perspective view of the present invention in its first use position and being utilized by an exerciser.
Figure 3:
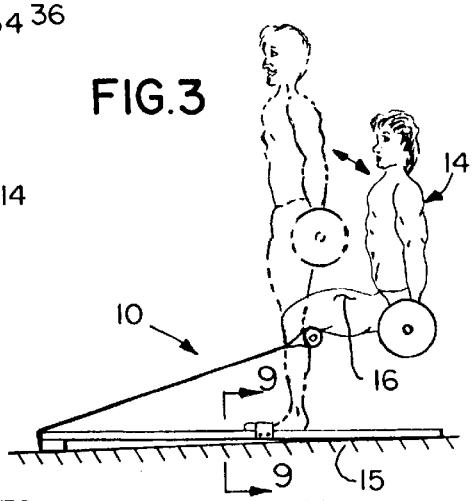
FIG. 3 is a diagrammatic perspective view of the present invention in its second use position and being utilized by an exerciser.

Referring now to the figures in which like numerals indicate like parts, and particularly to FIGS. 1–3, respectively, the portable device for exercising front thighs of the present invention is shown generally at 10 having a non-use position for carrying by a hand 12 of a user 14 and a use position for placement on a horizontal surface 15 and for exercising the front thighs 16 of the user 14.

Figure 4:
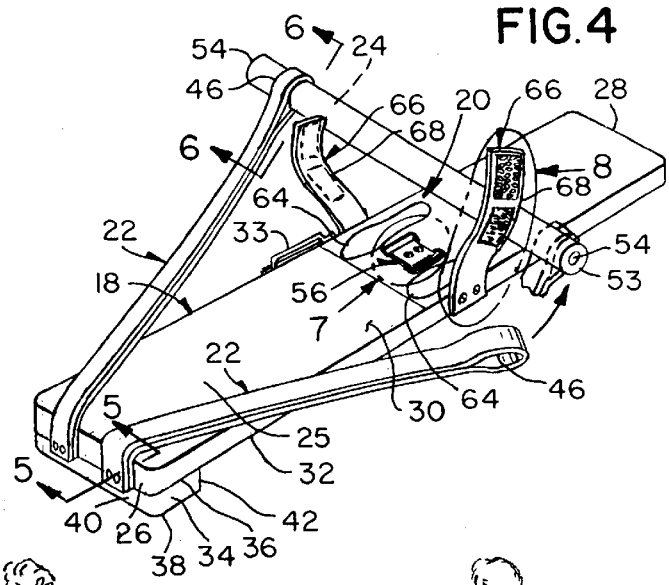
FIG. 4 is an enlarged diagrammatic perspective view of the area generally enclosed by the dotted curve identified by arrow 4 in FIG. 1 of the present invention.

The general configuration of the portable device for exercising front thighs 10 can best be seen in FIG. 4, and as such will be discussed with reference thereto.

The portable device for exercising front thighs 10 comprises a base 18 for placement on the horizontal surface 15 when the portable device for exercising front thighs 10 is in the use position, and feet restraints 20 disposed on the base for restraining the feet of the exerciser 14 when the portable device for exercising front thighs 10 is in the use position.

The portable device for exercising front thighs 10 further comprises a pair of support straps 22 that extend from the base 18 for supporting the exerciser 14 when the portable device for exercising front thighs 10 is in the use position, and a rod 24 for placement behind the knees of the exerciser 14 when the portable device for exercising front thighs 10 is in the use position and replaceably engages the pair of support straps 22 for further supporting the exerciser 14 when the portable device for exercising front thighs 10 is in the use position.

Figure 5:
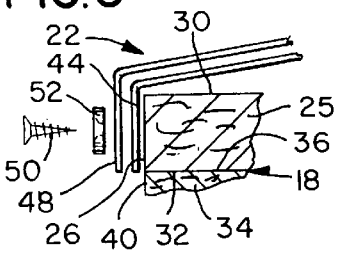
FIG. 5 is an enlarged cross sectional view taken on line 5—5 in FIG. 4.
Figure 6:
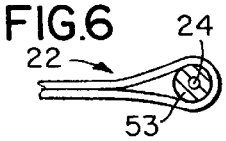
FIG. 6 is an enlarged cross sectional view taken on line 6—6 in FIG. 4.
Figure 8:
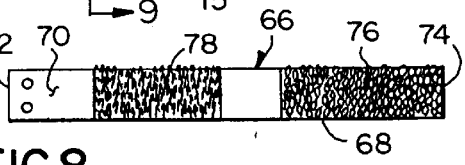
FIG. 8 is an enlarged diagrammatic top plan view of the area generally enclosed by the dotted ellipse identified by arrow 8 in FIG. 4 of the present invention.
Figure 7:
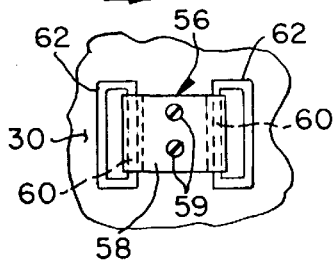
FIG. 7 is an enlarged diagrammatic top plan view of the area generally enclosed by the dotted ellipse identified by arrow 7 in FIG. 4 of the present invention.
Figure 9:
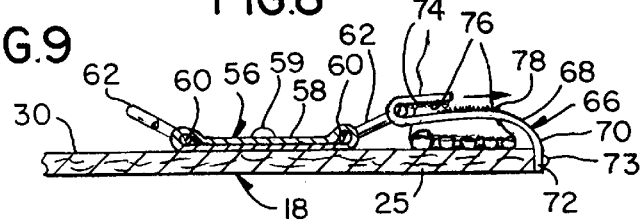
FIG. 9 is an enlarged cross sectional view taken on line 9—9 in FIGS. 2 and 3.

The specific configurations of the base 18, the pair of support straps 22, and the rod 24 can best be seen in FIGS. 4–6, and as such will be discussed with reference thereto.

The base 18 comprises a platform 25 that is generally rectangular-shaped and flat, made of wood, and has rounded corners, with a forwardmost end 26 thereof tapering to a rearmost end 28 thereof for placement on the horizontal surface 15 when the portable device for exercising front thighs 10 is in the use position, an uppermost surface 30, and a lowermost surface 32.

The base 18 further comprises a handle 33 for carrying the portable device for exercising front thighs 10 when in the non-use position. The handle 33 of the base 13 is nylon webbing folded in half lengthwise and affixed, at its ends, to a side of the platform 25 of the base 18, at about midway therealong.

The base 13 further comprises an inclined spacer 34 for inclining the platform 25 of the base 18 when the portable device for exercising front thighs 10 is in the use position. The inclined spacer of the base 18 is generally rectangular-shaped and flat, made of wood, and has rounded corners, with an uppermost surface 36 thereof contacting the lowermost surface 32 of the platform 25 of the base 18, a lowermost surface 38 thereof for placement on the horizontal surface 15 when the portable device for exercising front thighs 10 is in the use position, a forwardmost end 40 thereof in vertical alignment with the forwardmost end 26 of the platform 25 of the base 18 and tapering to a rearmost end 42 thereof.

The pair of support straps 22 are nylon webbing and spaced laterally apart. Each strap of the pair of support straps 22 is elongated and slender and has one end 44 thereof positioned on the forwardmost end 26 of the platform 25 of the base 18, extends upwardly and longitudinally rearwardly therefrom, doubles back on, and is affixed to, itself, with the formation of a loop 46 at its rearmost point, and terminates at its other end 48 on top of the one end 44 thereof, where a wood screw 50 and a washer 52 affix the one end 22 thereof and the other end 48 thereof to the forwardmost end 26 of the platform 25 of the base 18.

The rod 24 is elongated and slender and made of wood, and is covered by foam tube 53 for cushioning the rod 24 against the back of the knees of the exerciser 14 when the portable device for exercising front thighs 10 is in the use position. The rod 24 has a pair of free ends 54, each of which extends laterally through, and engages, a respective loop 46 of the pair of support straps 22, with the pair of support straps 22 straddling the legs of the exerciser 14 when the portable device for exercising front thighs 10 is in the use position.

The specific configuration of the feet restraints 20 can best be seen in FIGS. 4 and 7–9, and as such will be discussed with reference thereto.

The feet restraints 20 comprise an anchor 56 that is affixed to the uppermost surface 30 of the platform 25 of the base 18, along its longitudinal axis, approximately midway between the forwardmost end 25 of the platform 25 of the base 18 and the rearmost end 28 of the platform 25 of the base 18.

The anchor 56 of the feet restraints 20 comprises a center strap 58 that is affixed laterally, by screws 59, to the uppermost surface 30 of the platform 25 of the base 18, at its centerline, approximately midway between the forwardmost end 25 of the platform 25 of the base 18 and the rearmost end 28 of the platform 25 of the base 18.

The center strap 58 of the anchor 56 of the feet restraints 20 is nylon webbing folded and glued to itself, with the formation of longitudinal loops 60, at its lateral extremes.

The anchor 56 of the feet restraints 20 further comprises a pair of chain links 62, each of which extends through a respective loop of the longitudinal loops 60 of the center strap 58 of the anchor 56 of the feet restraints 20.

The feet restraints 20 further comprise a pair of non-skid foot pads 64 for positioning the feet of the exerciser 14 when the portable device for exercising front thighs 10 is in the use position. The pair of non-skid foot pads 64 of the feet restraints 20 are affixed longitudinally to the uppermost surface 30 of the platform 25 of the base 18, and straddle the anchor 56 of the feet restraints 20.

The pair of non-skid foot pads 64 of the feet restraints 20 are a non-skid adhesive backed material cut to the shape of the right and left feet, respectively, of the exerciser 14.

The feet restraints 20 further comprise a pair of foot straps 66 for restraining the feet of the exerciser 14. Each strap of the pair of foot straps 66 of the feet restraints 20 is nylon webbing and comprises a strap portion 68 that is slender and elongated, and has an upper surface 70 and a fixed end 72 that is affixed to a respective side of the platform 25 of the base 18, by screws 73, with a respective foot strap of the pair of foot straps 66 of the feet restraints 20 extending upwardly and laterally inwardly therefrom, towards the anchor 56 of the feet restraints 20, where it terminates in a free end 74.

Each strap of the pair of foot straps 66 of the feet restraints 20 further comprises one portion of hook and loop fasteners 76 disposed on the upper surface 70 thereof, and extends from the free end 74 thereof to about midway between the fixed end 72 thereof and the free end 74 thereof.

Each strap of the pair of foot straps 66 of the feet restraints 20 further comprises a mating portion of hook and loop fasteners 78 disposed on the upper surface 70 thereof, and extends spaced from the one portion of hook and loop fasteners 76 to prior to the fixed end 72, with a foot or the exerciser 14 positioned on a respective foot pad of the pair of foot pads 64 of the feet restraints 20, with the free end 74 of a respective strap of the pair of foot straps 66 of the feet restraints 20 extending over the respective foot of the exerciser 14, through a respective link of the pair of chain links 62 of the feet restraints 20, extending back over the respective strap of the pair of foot straps 66 of the feet restraints 20, pulled to snug the respective foot of the exerciser 14 in place, and with the one portion of hook and loop fasteners 76 engaging the mating portion of hook and loop fasteners 78 so as to form an engaged strap to maintain the respective foot of the exerciser 14 in place when the portable device for exercising the front thigh 10 is in the use position.

The rearmost point of each strap of the pair of support straps 22 extends through one engaged strap when the portable device for exercising front thighs 10 is in the non-use position, with the rod 24 removed from the pair of support straps 22 and extended through the other engaged strap when the portable device for exercising front thighs 10 is in the non-use position, and with the handle 33 allowing the portable device for exercising front thighs 10 to be carried when in the non-use position.

It will be understood that each of the elements described above, or two or more together, may also find a useful application in other types of constructions differing from the types described above.

While the invention has been illustrated and described as embodied in a portable device for exercising front thighs, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable device for exercising front thighs having a non-use position for carrying by a hand of a user and a use position for placement on a horizontal surface and for exercising the front thighs of the user, said device comprising:

a) a base for placement on the horizontal surface when said portable device for exercising front thighs is in said use position; said base comprising a platform being generally rectangular-shaped and flat, made of wood, and having rounded corners, with a forwardmost end thereof tapering to a rearmost end thereof for placement on the horizontal surface when said portable device for exercising front thighs is in said use position, an uppermost surface, and a lowermost surface;

b) feet restraints disposed on said base for restraining the feet of said exerciser when said portable device for exercising front thighs is in said use position;

c) a pair of support straps extending from said base for supporting said exerciser when said portable device for exercising front thighs is in said use position; and d) a rod for placement behind the knees of the exerciser when said portable device for exercising front thighs is in said use position and removably engages said pair of support straps for further supporting the exerciser when said portable device for exercising front thighs is in said use position.

2. The device as defined in claim 1, wherein said base further comprises a handle for carrying said portable device for exercising front thighs when in said non-use position.

3. The device as defined in claim 2, wherein said handle of said base is nylon webbing folded in half lengthwise and affixed, at its ends, to a side of said platform of said base, at about midway therealong.

4. The device as defined in claim 1, wherein said base further comprises an inclined spacer for inclining said platform of said base when said portable device for exercising front thighs is in said use position.

5. The device as defined in claim 4, wherein said inclined spacer of said base is generally rectangular-shaped and flat, made of wood, and has rounded corners, with an uppermost surface thereof contacting said lowermost surface of said platform of said base, a lowermost surface thereof for placement on the horizontal surface when said portable device for exercising front thighs is in said use position, a forwardmost end thereof in vertical alignment with said forwardmost end of said platform of said base and tapering to a rearmost end thereof.

6. The device as defined in claim 1, wherein said pair of support straps are nylon webbing and spaced laterally apart.

7. The device as defined in claim 1, wherein each strap of said pair of support straps is elongated and slender and has one end thereof positioned on said forwardmost end of said platform of said base, extends upwardly and longitudinally rearwardly therefrom, doubles back on, and is affixed to, itself, with the formation of a loop at its rearmost point, and terminates at its other end on top of said one end thereof, where a wood screw and a washer affix said one end thereof and said other end thereof to said forwardmost end of said platform of said base.

8. The device as defined in claim 1, wherein said rod is elongated and slender and made of wood, and is covered by a foam tube for cushioning said rod against the back of the knees of the exerciser when said portable device for exercising front thighs is in said use position.

9. The device as defined in claim 7, wherein said rod has a pair of free ends, each of which extends laterally through, and removably engages, a respective loop of said pair of support straps, with said pair of support straps staddling the legs of the exerciser when said portable device for exercising front thighs is in said use position.

10. The device as defined in claim 1, wherein said feet restraints comprise an anchor that is affixed to said uppermost surface of said platform of said base, along its longitudinal axis, approximately midway between said forwardmost end of said platform of said base and said rearmost end of said platform of said base.

11. The device as defined in claim 10, wherein said anchor of said feet restraints comprises a center strap that is affixed laterally, by screws, to said uppermost surface of said platform of said base, at its centerline, approximately midway between said forwardmost end of said platform of said base and said rearmost end of said platform of said base.

12. The device as defined in claim 11, wherein said center strap of said anchor of said feet restraints is nylon webbing folded and glued to itself, with the formation of longitudinal loops, at its lateral extremes.

13. The device as defined in claim 12, wherein said anchor of said feet restraints further comprises a pair of chain links, each of which extends through a respective loop of said longitudinal loops of said center strap of said anchor of said feet restraints.

14. The device as defined in claim 10, wherein said feet restraints further comprise a pair of non-skid foot pads for positioning the feet of the exerciser when said portable device for exercising front thighs is in said use position.

15. The device as defined in claim 14, wherein said pair of non-skid foot pads of said feet restraints are affixed longitudinally to said uppermost surface of said platform of said base, and straddle said anchor of said feet restraints.

16. The device as defined in claim 14, wherein said pair of non-skid foot pads of said feet restraints are a non-skid adhesive backed material cut to the shape of the right and left feet, respectively, of the exerciser.

17. The device as defined in claim 13, wherein said feet restraints further comprise a pair of foot straps for restraining the feet of the exerciser.

18. The device as defined in claim 17, wherein each strap of said pair of foot straps of said feet restraints is nylon webbing and comprises a strap portion that is slender and elongated, and has an upper surface and a fixed end that is affixed to a respective side of said platform of said base, by screws, with a respective foot strap of said pair of foot straps of said feet restraints extending upwardly and laterally inwardly therefrom, towards said anchor of said feet restraints, where it terminates in a free end.

19. The device as defined in claim 18, wherein each strap of said pair of foot straps of said feet restraints further comprises one portion of hook and loop fasteners disposed on said upper surface thereof, and extends from said free end thereof to about midway between said fixed end thereof and said free end thereof.

20. The device as defined in claim 19, wherein each strap of said pair of foot straps of said feet restraints further comprises a mating portion of hook and loop fasteners disposed on said upper surface thereof, and extends spaced from said one portion of hook and loop fasteners to prior to said fixed end, with a foot of the exerciser positioned on a respective foot pad of said pair of foot pads of said feet restraints, with said free end of a respective strap of said pair of foot straps of said feet restraints extending over the respective foot of the exerciser, through a respective link of said pair of chain links of said feet restraints, extending back over said respective strap of said pair of foot straps of said feet restraints, pulled to snug the respective foot of the exerciser in place, and with said one portion of hook and loop fasteners engaging said mating portion of hook and loop fasteners so as to form an engaged strap to maintain the respective foot of the exerciser in place when said portable device for exercising said front thigh is in said use position.

21. The device as defined in claim 20, wherein said rearmost point of each strap of said pair of support straps extends through one engaged strap when said portable device for exercising front thighs is in said non-use position, with said rod removed from said pair of support straps and extended through the other engaged strap when said portable device for exercising front thighs is in said non-use position.

* * * * *